US006061867A

United States Patent [19]

Schorpp et al.

[11] Patent Number: 6,061,867

[45] Date of Patent: May 16, 2000

[54] METHOD AND DEVICE FOR ELIMINATING PEELED-OFF SURFACE PORTIONS OF AN INK-REPELLENT LAYER OF AN OFFSET PRINTING PLATE

[75] Inventors: Andreas Schorpp, Bruchsal-Obergrombach; Bernhard Mechler, Heidelberg; Andreas Detmers, Mauer, all of Germany

[73] Assignee: Heidelberger Druckmaschinen AG, Heidelberg, Germany

[21] Appl. No.: 09/084,559

[22] Filed: May 26, 1998

[30] Foreign Application Priority Data

May 26, 1997 [DE] Germany ..... 197 21 909

[51] Int. Cl.[7] ..... A46B 9/02

[52] U.S. Cl. ..... 15/308; 15/256.52; 15/230.12; 15/230.13

[58] Field of Search ..... 15/256.52, 256.51, 15/88.3, 88.2, 308, 301, 97.1, 179, 182, 183, 230, 230.12, 230.19; 101/423, 425

[56] References Cited

U.S. PATENT DOCUMENTS

| | | |
|---|---|---|
| 1,654,940 | 1/1928 | Lucas . |
| 3,916,426 | 10/1975 | Brown . |
| 4,393,778 | 7/1983 | Kaneko . |
| 4,673,284 | 6/1987 | Matsumoto et al. . |
| 4,706,320 | 11/1987 | Swift . |
| 5,009,161 | 4/1991 | Wirz . |
| 5,128,725 | 7/1992 | Frankel et al. . |
| 5,237,376 | 8/1993 | Giardina . |
| 5,322,015 | 6/1994 | Gasparrini . |
| 5,730,057 | 3/1998 | Loftus et al. . |
| 5,813,082 | 9/1998 | Stevens, Jr. . |
| 5,931,096 | 8/1999 | Detmers et al. . |

FOREIGN PATENT DOCUMENTS

| | | |
|---|---|---|
| 7630029 | 1/1977 | Germany . |
| 36 14 496 | 11/1987 | Germany . |
| 39 07 611 | 5/1994 | Germany . |
| 196 00 846 | 4/1997 | Germany . |
| 196 00 844 | 7/1997 | Germany . |
| 196 27 748 | 1/1998 | Germany . |
| 38 12 678 | 4/1998 | Germany . |

*Primary Examiner*—Terrence R. Till
*Assistant Examiner*—Jennifer McNeil
*Attorney, Agent, or Firm*—Kenyon & Kenyon

[57] ABSTRACT

A method and a device for eliminating peeled-off surface portions of an ink-repellent layer of an offset printing plate. With known plate-cylinder washing devices such peeled-off surface portions of an ink-repellent layer cannot be eliminated from the offset printing plate completely. The method and device according to the present invention enables the complete elimination of said peeled-off surface portions. Using the surface of non-woven fabric mounted on a shaft in spiral-like manner, the ink-repellent layer is brushed off without any fluid added. The method and device are used in connection with the direct imaging of offset printing plates in the dry-offset process.

5 Claims, 1 Drawing Sheet

METHOD AND DEVICE FOR ELIMINATING PEELED-OFF SURFACE PORTIONS OF AN INK-REPELLENT LAYER OF AN OFFSET PRINTING PLATE

FIELD OF THE INVENTION

The present invention relates to a method and a device for eliminating peeled-off or loosened surface portions of an ink-repellent layer of an offset printing plate.

RELATED TECHNOLOGY

A direct-imaging printing method requires imaging to take place on printing plates having an ink-repellent layer. In order to image such printing plates, surface portions of the ink-repellent silicone layer are peeled off or loosened from an underlying polyester layer, for example, by means of laser. Thus, the polyester layer, in as far as it has been freed from the silicone layer, represents the ink-receptive layer, and the remaining silicone layer represents the ink-repellent layer. Immediately after imaging it is necessary that the loosened or peeled-off portions of the silicone layer are eliminated from the printing plate.

DE 196 27 748.5 discloses a device for eliminating the silicone layer. This device includes a cleaning cloth which is engaged with the plate cylinder for taking up the silicone particles. This cleaning cloth consists of a non-woven fabric of reinforced and bonded microfibers. However, when the entire surface is imaged, this cleaning cloth is not able to take up the silicone particles in the form of foil-like pieces which tend to curl up to assume a shape similar to a thread.

From the German Utility Model 76 30 829, which is not necessarily analogous art to the present invention, there is known a brush-type washing device for circular stencils. The device comprises a roller, on the circumference of which the bristles are arranged in spiral-like manner; such a brush-roller may be soiled to a lesser degree than a roller with bristles in a more dense arrangement than the spiral-like manner.

SUMMARY OF THE INVENTION

It is an object of the present invention to provide a method and device so that elimination of the mentioned peeled-off surface portions of a silicone layer from of the surface of the printing plate can be ensured without problems.

The present invention therefore provides a brush (3) for the elimination of peeled-off surface portions of an ink-repellent layer of an offset printing plate (2), the bristles of the brush being arranged in spiral-like manner, characterized in that the brush (3) comprises a shaft (7) having a dirt-repellent layer and a raised surface (8) of non-woven fabric arranged thereon in spiral-like manner.

Advantageously, the brush may further provide: (a) that the spiral-shaped surface (8) of non-woven fabric extends in a groove (11) milled in the shaft (7); (b) that the surface (8) of non-woven fabric is fastened in the groove (11) using double-sided adhesive tape (12); (c) that the brush (3) is associated with a suction device; and (d) that the suction opening (6) of the suction device is coated with a dirt-repellent layer.

The present invention also provides a method for eliminating peeled-off surface portions of an ink-repellent layer of an offset printing plate, characterized in that a spiral-shaped brush is engaged with a plate cylinder carrying an offset printing plate without fluid being applied, that the directions of rotation of the plate cylinder and of the brush are opposite, and that the surface portions taken up by the brush are sucked up by a suction device.

Advantageously, the method may further provide: (a) that the directions of rotation of the plate cylinder and of the brush are identical, whereby there exists a relative speed between both rotating parts; (b) that the direction of rotation of the brush is oriented to the suction opening; and (c) that the directions of rotation of the brush and of the plate cylinder are reversed after a certain time or a defined number of revolutions.

According to the present invention, a brush is formed of a shaft on which a strip of non-woven fabric is applied in spiral-like manner. This construction has the advantage that the so-called threads of peeled-off material in the spaces between the spiral of non-woven fabric cannot become entwined with the latter. Additionally, a suction device is provided which is arranged in the immediate vicinity of the brush for sucking up the silicone particles taken up by the brush. It is furthermore advantageous that the suction opening of the suction device is coated with a dirt-repelling layer, so that the silicone particles will not adhere to it.

According to the present invention, the strip of non-woven fabric is fixed to the shaft in that it is fastened in a groove provided in the shaft using a double-sided adhesive tape. Thus, the pressman has the option to replace the strip of non-woven fabric quickly with a new one, when the present one is worn or soiled. Additionally, the surface of non-woven fabric for taking up the silicone particles and the surface of space created between the non-woven-fabric surface, due to the spiral windings of said fabric, should be brought into an optimal relationship. Thereby, it is ensured that, on the one hand, there is sufficient surface of non-woven fabric to take up the silicone particles and, on the other hand, the spaces formed between the non-woven fabric represent a rather small surface to which the so-called threads of silicone to be eliminated may adhere.

A further exemplary embodiment of the present invention provides, that also the spaces between the strips of non-woven fabric are coated with a dirt-repellent layer, such as, for example, teflon.

According to a suitable method for the elimination of surface portions of a layer as described above, in particular of silicone particles, a first cleaning is carried out by engaging the brush according to the present invention with the plate cylinder, without applying washing fluid or the like. The brush and the plate cylinder, on which the offset printing plate to be cleaned is mounted, rotate in opposite directions, whereby the brush is oriented to the suction device. After a defined number of revolutions a reversal of the direction of rotation of both rotating parts takes place. This has the advantage that the two edges of the imaged offset plate, which extend in parallel with the axis of the brush, can be cleaned more thoroughly.

In an alternative embodiment of the present invention the plate cylinder and the brush can be rotated in the same direction. However, here it is required that a relative speed develops between both rotating parts, which means that the circumferential speeds of both rotating parts are different.

In a further method step additional cleaning must be carried out using the conventional cleaning cloth and the use of washing fluid. This may be required, because very fine silicone dust created in the peel-off process cannot be taken up by the brush.

BRIEF DESCRIPTION OF THE DRAWINGS

The present invention will become more apparent from the following description of the exemplary embodiments in view of the accompanying drawings, in which.

DETAILED DESCRIPTION

Figure 1:
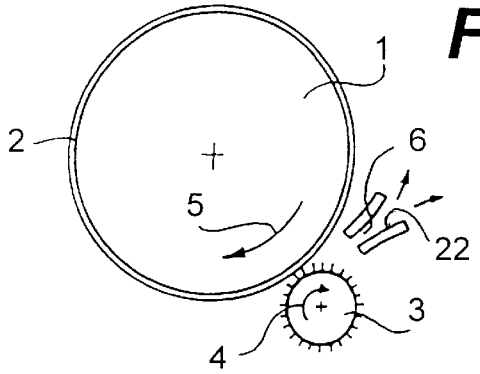
FIG. 1 is an illustration according to the present invention of the arrangement of plate cylinder, brush and suction opening of the suction device.

FIG. 1 shows a plate cylinder 1, on the circumference of which an offset printing plate 2 is mounted. Such an offset printing plate 2 is used, for example, with a direct-imaging method of plate-imaging. To the plate cylinder 1 there is engaged a brush 3, the direction of rotation of which (see arrow 4) being opposite to the direction of rotation of the plate cylinder 1 (see arrow 5). In the gap formed between plate cylinder 1 and brush 3 there is arranged a suction opening 6 which is connected with a non-illustrated suction device. Suction opening 6 may be coated with a dirt-repelling layer 22. The direction of rotation of the brush 3 is oriented to the suction opening 6.

Figure 2:
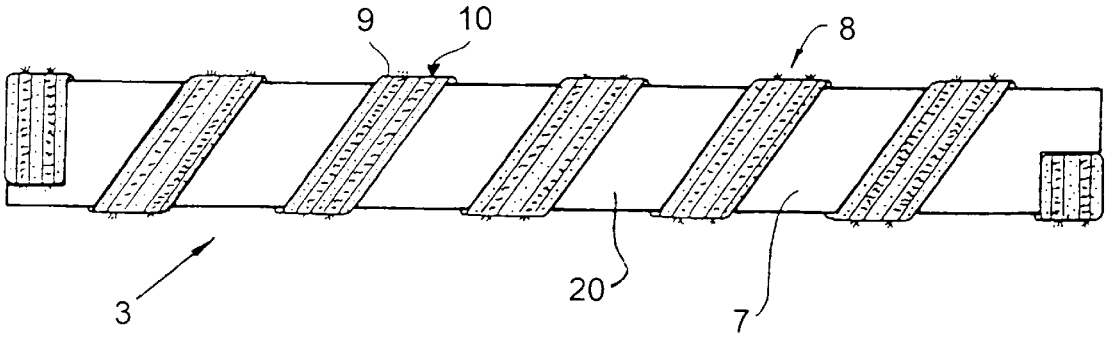
FIG. 2 is a view of the construction of the brush.

FIG. 2 shows the brush 3 which comprises a shaft 7, whereon a strip of non-woven fabric 8 is mounted in spiral-like manner. Advantageously, the non-woven fabric 8 comprises various materials 9, 10 which differ in structure and length of fiber. A dirt-repellent layer 20 can be used to coat the shaft 7 in the spaces between the strips of non-woven fabric 8.

Figure 3:
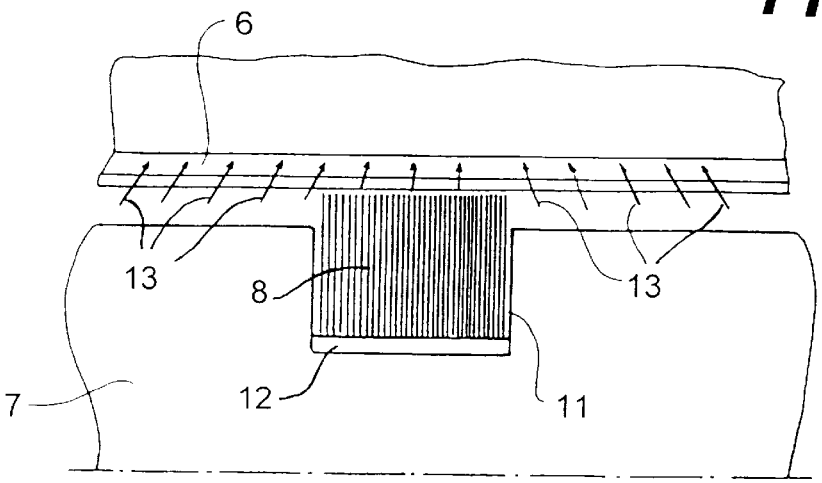
FIG. 3 is a detailed illustration of the brush and the suction opening indicated in FIG. 1.

FIG. 3 shows a shaft 7 into which a groove is milled. In this groove 11 a strip of double-sided adhesive tape 12 is applied and the strip of non-woven fabric 8 is fastened thereon. In the immediate vicinity of the brush 3 the suction opening 6 of the suction device is located, the distance from the suction opening 6 to the brush 6 being chosen as such, so that the suction-air stream 13 is not broken off.

Non-woven fabric as defined herein can include for example fleece.

What is claimed is:

1. A brush for eliminating peeled-off or loosened surface portions of an ink-repellent layer of an offset printing plate, the brush comprising:

a shaft having a dirt-repellant layer; and a non-woven fabric having a raised surface, the non-woven fabric being arranged in spiral-like manner about the shaft.

2. The brush as recited in claim 1 wherein the shaft has a milled groove and the non-woven fabric is located in the groove.

3. The brush as recited in claim 2 further comprising double-sided adhesive tape, the non-woven fabric being fastened in the groove using the double-sided adhesive tape.

4. A cleaning device with a brush for eliminating peeled-off or loosened surface portions of an ink-repellent layer of an offset printing plate, comprising:

a shaft of the brush having a dirt-repellent layer;

a non-woven fabric having a raised surface, the non-woven fabric being arranged in spiral-like manner about the shaft; and a suction device.

5. The cleaning device as recited in claim 4 wherein the suction device has a suction opening coated with a second dirt-repellent layer.

* * * * *